US010779704B2

(12) United States Patent
Koepke et al.

(10) Patent No.: US 10,779,704 B2
(45) Date of Patent: Sep. 22, 2020

(54) DISHWASHER APPLIANCE HAVING AN INTEGRATED DIVERTER

(71) Applicant: Haier US Appliance Solutions, Inc., Wilmington, DC (US)

(72) Inventors: Steven Chadwick Koepke, LaGrange, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 354 days.

(21) Appl. No.: 15/860,718

(22) Filed: Jan. 3, 2018

(65) Prior Publication Data

US 2019/0200840 A1 Jul. 4, 2019

(51) Int. Cl.
*A47L 15/22* (2006.01)
*A47L 15/42* (2006.01)

(52) U.S. Cl.
CPC ..... *A47L 15/4221* (2013.01); *A47L 15/22* (2013.01); *A47L 15/4225* (2013.01)

(58) Field of Classification Search
CPC ... A47L 15/22; A47L 15/4221; A47L 15/4225
USPC .. 134/56 D, 57 D, 58 D, 182, 198, 199, 200
See application file for complete search history.

(56) References Cited

U.S. PATENT DOCUMENTS

| | | | |
|---|---|---|---|
| 7,914,625 | B2 | 3/2011 | Bertsch et al. |
| 8,282,741 | B2 | 10/2012 | Bertsch et al. |
| 8,574,373 | B2 | 11/2013 | Delgado et al. |
| 2010/0269938 | A1 | 10/2010 | Busing et al. |
| 2012/0266924 | A1 | 10/2012 | Boyer et al. |
| 2012/0318389 | A1 | 12/2012 | Holstein et al. |
| 2013/0000762 | A1 | 1/2013 | Buddharaju et al. |
| 2016/0367106 | A1 | 12/2016 | Thiyagarajan et al. |

FOREIGN PATENT DOCUMENTS

| | | | |
|---|---|---|---|
| EP | 1728461 | A1 | 12/2006 |
| WO | WO2010052040 | A3 | 9/2010 |

*Primary Examiner* — Levon J Shahinian
(74) *Attorney, Agent, or Firm* — Dority & Manning, P.A.

(57) ABSTRACT

A dishwasher appliance having a diverter integrated with a sump of the dishwasher appliance is provided. Features of the diverter integrated with the sump provide for more efficient development of, tooling for, and manufacture of the dishwasher appliance. Further, features of the diverter integrated with the sump may reduce leakage between the sump and the diverter and may also reduce part count of the dishwasher appliance.

15 Claims, 7 Drawing Sheets

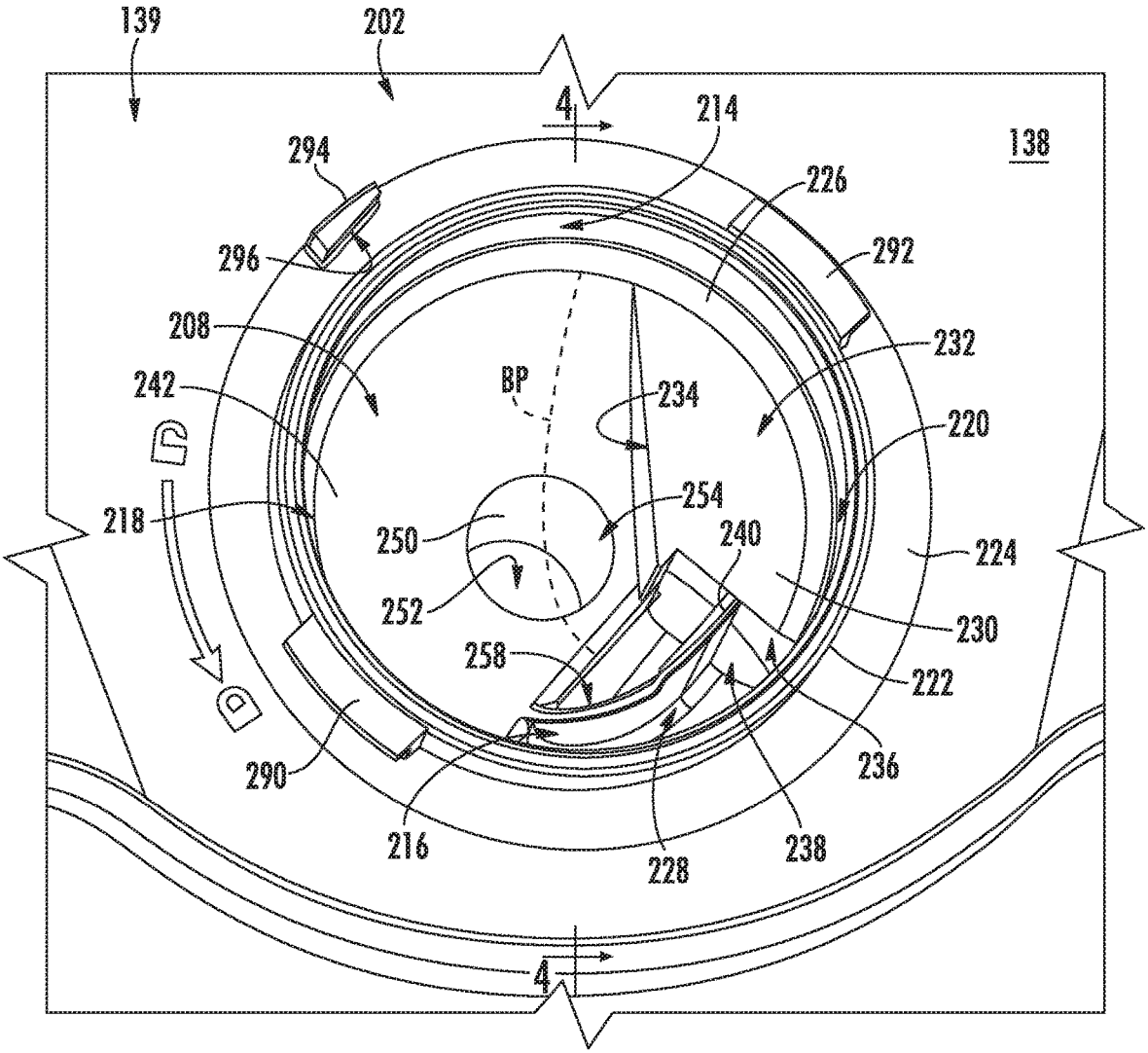
FIG. 3
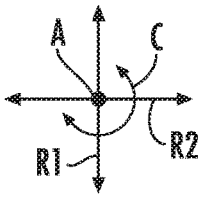

DISHWASHER APPLIANCE HAVING AN INTEGRATED DIVERTER

FIELD OF THE INVENTION

The present subject matter relates generally to dishwasher appliances and more particularly to diverters for dishwasher appliances.

BACKGROUND OF THE INVENTION

Dishwasher appliances generally include a tub and spray assemblies. The spray assemblies direct sprays of wash fluid onto articles within the tub during operation of the dishwasher appliance. The wash fluid sprayed from spray assemblies eventually flows to a sump typically positioned at a bottom portion of the tub. To supply wash fluid to the spray assemblies, dishwasher appliances generally include a pump, which may receive wash fluid from the sump to recirculate within the tub. Further, conventional dishwasher appliances typically use a diverter device to control the flow of fluid within the dishwasher appliance. Such diverter devices typically incorporate a diverter element within a diverter housing to selectively control which spray arm assemblies receives fluid. In this way, a single zone may be washed at a time, which may reduce the amount of water and energy needed to operate the dishwasher appliance. Such diverter devices are typically installed in or near the sump of the dishwasher appliance.

Separately forming the sump and a diverter housing poses certain challenges. For example, the joints between the sump and the tub and/or the sump and a diverter housing can leak, and fluid from such leaks can, for example, damage components of the dishwasher appliance and/or the area in which the dishwasher is installed, such as, e.g., kitchen cabinets that may surround the dishwasher and/or the floor beneath the dishwasher. Additional components to prevent leaks, such as, e.g., seals, gaskets, or the like, and/or manufacturing techniques such an overmolding process to depose a polymer or other suitable material onto, e.g., the diverter housing in the area where the housing is joined to the sump, can increase the time and expense of the dishwasher appliance and leaks can still occur in spite of such precautions.

Further, some dishwasher appliances are configured with a diverter device that selectively directs fluid to two zones and some dishwasher appliances are configured with a diverter device that selectively directs fluid to more than two zones. For two zone diverter devices, traditionally lower cost solutions have been used. As one example, a ball diverter system that includes a ball that is switchable between two outlet ports of the diverter depending on the selected zone may be employed. For diverter devices configured to selectively direct fluid to more than two zones, conventionally disc diverter systems or other systems are employed. Manufacture of these different diverter systems may pose certain challenges due to the geometries needed for such systems. For instance, the varying diverter system designs may require separate or different development processes, tooling, and/or manufacturing processes.

Accordingly, a dishwasher appliance having one or more features that address one or more of the noted challenges would be useful.

BRIEF DESCRIPTION OF THE INVENTION

The present disclosure provides a dishwasher appliance that includes one or more features that provide for more efficient development of, tooling for, and manufacture of the dishwasher appliance. Further, the dishwasher appliance includes one or more features that reduce leakage between a sump and a diverter device of the dishwasher appliance, as well as part count. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub defining a wash chamber. The dishwasher appliance also includes a plurality of spray arm assemblies for directing fluid into the wash chamber. Further, the dishwasher appliance includes a pump and a sump positioned at or proximate a bottom portion of the tub, the sump comprising a sump portion and a diverter bottom, the diverter bottom defining an inlet port in fluid communication with the pump and comprising an arcuate wall and a cylinder extending from the arcuate wall, the arcuate wall and the cylinder defining a chamber. In addition, the dishwasher appliance includes a diverter top removably mounted to the diverter bottom to form a diverter, the diverter top defining at least two outlets ports in fluid communication with the plurality of spray arm assemblies. Also, the dishwasher appliance includes a diverter element movable within the chamber, the diverter element configured to divert fluid from the inlet to the plurality of outlet ports.

In a second exemplary embodiment, a dishwasher appliance defining a vertical direction, a lateral direction, and a transverse direction is provided. The dishwasher appliance includes a tub defining a wash chamber and a plurality of spray arm assemblies for directing fluid into the wash chamber. The dishwasher appliance also includes a pump and a sump positioned at or proximate a bottom portion of the tub along the vertical direction, the sump comprising a sump portion and a diverter bottom integrally formed with the sump portion, the diverter bottom defining an inlet port in fluid communication with the pump, the diverter bottom comprising an arcuate wall extending between a top portion and a bottom portion along the vertical direction and a cylinder extending from the arcuate wall along the vertical direction, the arcuate wall and the cylinder defining a chamber. Further, the dishwasher appliance includes a diverter top removably mounted to the diverter bottom to form a diverter, the diverter top defining at least two outlets ports in fluid communication with the plurality of spray arm assemblies. Moreover, the dishwasher appliance includes a diverter element movable within the chamber, the diverter element configured to divert fluid from the inlet to the plurality of outlet ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 provides a top perspective view of a diverter bottom according to an exemplary embodiment of the present disclosure;

Use of the same reference numerals in different figures denotes the same or similar features.

DETAILED DESCRIPTION

Figure 1:
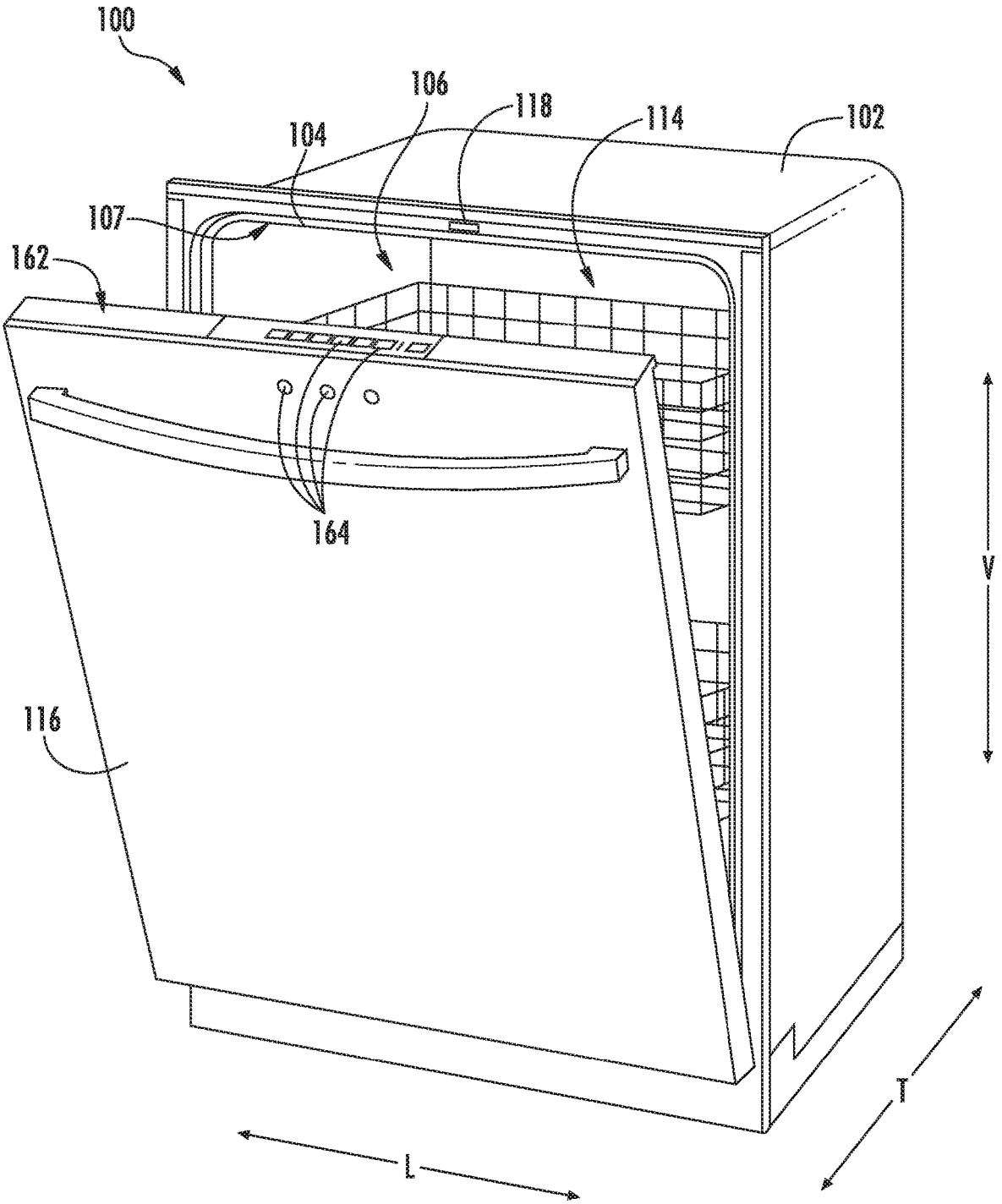
FIG. 1 provides a perspective view of an exemplary embodiment of a dishwasher appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
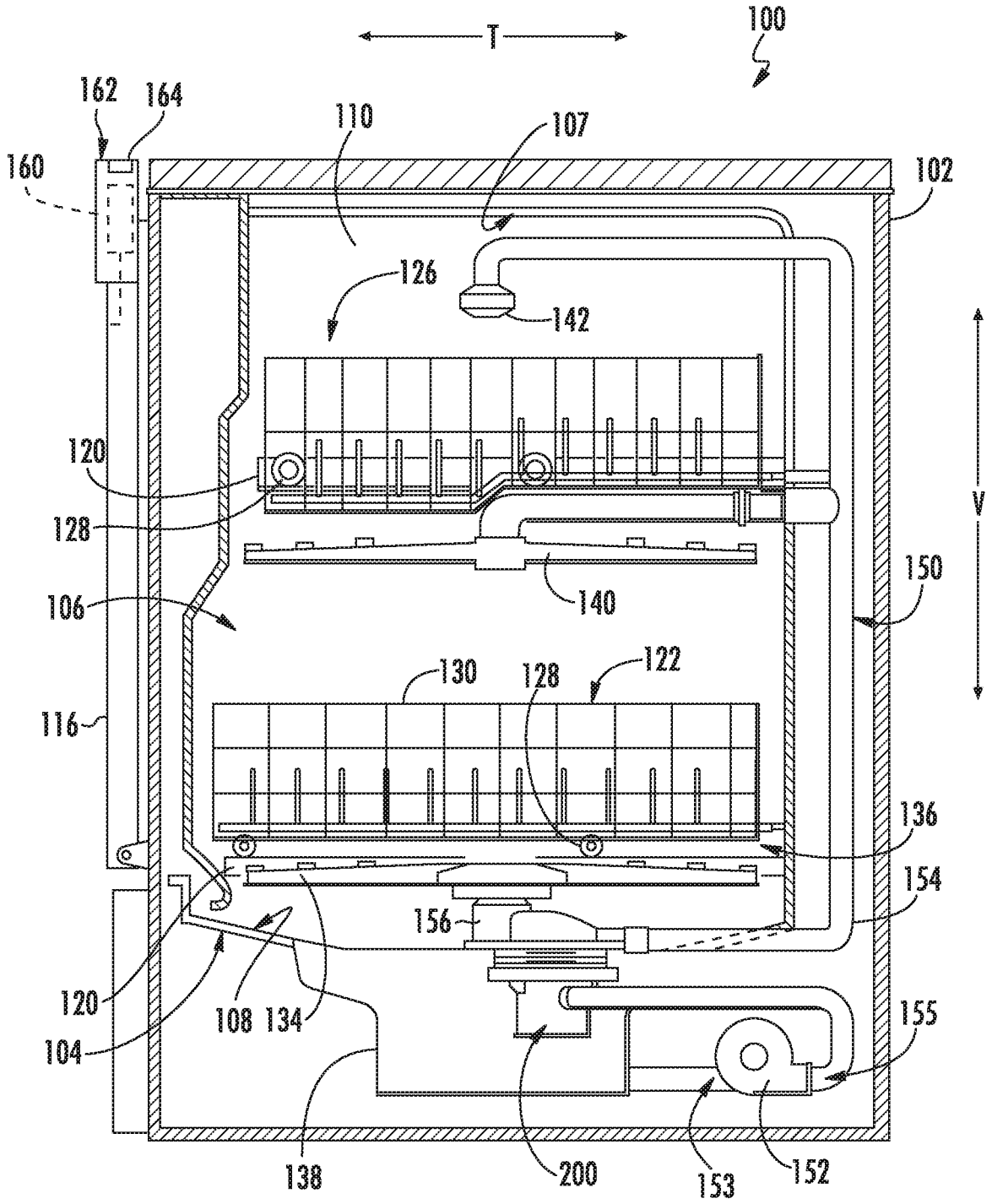
FIG. 2 provides a side, cross sectional view of the dishwasher appliance of FIG. 1.

FIGS. 1 and 2 depict a dishwasher appliance 100 according to an exemplary embodiment of the present disclosure. Dishwasher appliance 100 defines a vertical direction V, a lateral direction L (FIG. 1) and a transverse direction T. The vertical, lateral, and transverse directions V, L, and T are mutually perpendicular and form an orthogonal direction system.

Dishwasher 100 includes a housing or cabinet 102 having a tub 104 disposed therein that defines a wash chamber 106. As shown in FIG. 2, tub 104 extends between a top 107 and a bottom 108 along the vertical direction V, between a pair of side walls 110 along the lateral direction L (only one shown in FIG. 2), and between a front side and a rear side along the transverse direction T. Tub 104 includes a front opening 114 (FIG. 1) and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. Dishwasher 100 includes a door closure mechanism or assembly 118 (FIG. 1) that is used to lock and unlock door 116 for accessing and sealing wash chamber 106.

As further shown in FIG. 2, tub sidewalls 110 accommodate a plurality of rack assemblies. More specifically, guide rails 120 are mounted to sidewalls 110 for supporting a lower rack assembly 122 and an upper rack assembly 126. Upper rack assembly 126 is positioned at a top portion of wash chamber 106 and lower rack assembly 122 is positioned at a bottom portion of wash chamber 106. Each rack assembly 122, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 126, respectively. Although guide rails 120 and rollers 128 are illustrated herein as facilitating movement of the respective rack assemblies 122, 126, it should be appreciated that any suitable sliding mechanism or member may be used according to alternative embodiments.

Some or all of the rack assemblies 122, 126 are fabricated into lattice structures including a plurality of wires or elongated members 130 (for clarity of illustration, not all elongated members making up rack assemblies 122, 126 are shown in FIG. 2). In this regard, rack assemblies 122, 126 are generally configured for supporting articles within wash chamber 106 while allowing a flow of wash fluid to reach and impinge on those articles, e.g., during a cleaning or rinsing cycle. According to other exemplary embodiments, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and is disposed below upper rack assembly 126 along the vertical direction V. In this regard, mid-level spray arm assembly 140 is generally configured for urging a flow of wash fluid up through upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 126.

The various spray assemblies described herein may be part of a fluid circulation assembly 150 for circulating water and wash fluid in tub 104. In addition to the spray assemblies, fluid circulation assembly 150 includes a pump 152 for circulating water and wash fluid (e.g., detergent, water, and/or rinse aid) to the spray assemblies such that wash fluid may be dispensed in tub 104. Pump 152 is located within a machinery compartment located below or proximate sump 138 of tub 104. For this exemplary embodiment, pump 152 receives fluid from sump 138 through a pump inlet 153 and pumps the wash fluid through a pump outlet 155 to an inlet port 238 (FIGS. 3 and 4) of a diverter 200. Diverter 200 selectively distributes the wash fluid to the spray arm assemblies 134, 140, 142 and/or other spray manifolds or devices such that wash fluid is sprayed into tub 104 into a desired zone. Fluid circulation assembly 150 may include various fluid conduits or circulation piping for directing water and/or wash fluid from diverter 200 to the various spray assemblies 134, 140, and 142. For example, for the embodiment depicted in FIG. 2, supply conduit 154 extends from diverter 200 to mid-level spray arm assembly 140 and upper spray assembly 142 and supply conduit 156 extends from diverter 200 to lower spray arm assembly 134 to supply wash fluid thereto. However, it should be appreciated that according to alternative embodiments, any other suitable plumbing configuration may be used to supply wash fluid throughout the various spray manifolds and assemblies described herein. For example, according to another exemplary embodiment, supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray assembly 134, 140 includes an arrangement of discharge ports or orifices for directing washing liquid received from diverter 200 onto dishes or other articles located in upper and lower rack assemblies 120. The arrangement of the discharge ports in spray-arm assemblies 134, 140 provides a rotational force by virtue of washing fluid flowing through the discharge ports. The resultant rotation of spray-arm assemblies 134, 140 and the operation of spray assembly 142 using fluid from diverter 200 provides coverage of dishes and other dishwasher contents with a washing spray. Other configurations of spray assemblies may be used as well.

Dishwasher 100 is equipped with a controller 160 to regulate operation of dishwasher 100, e.g., to control which zones within wash chamber 106 are to receive wash fluid. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, bistable gates, AND gates, and the like) to perform control functionality instead of relying upon software.

Controller 160 may be positioned in a variety of locations throughout dishwasher 100. In the illustrated embodiment, controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 126, different spray arm assemblies 134, 140, 142 may be used, and other differences may be applied while remaining within the scope of the present subject disclosure.

Figure 4:
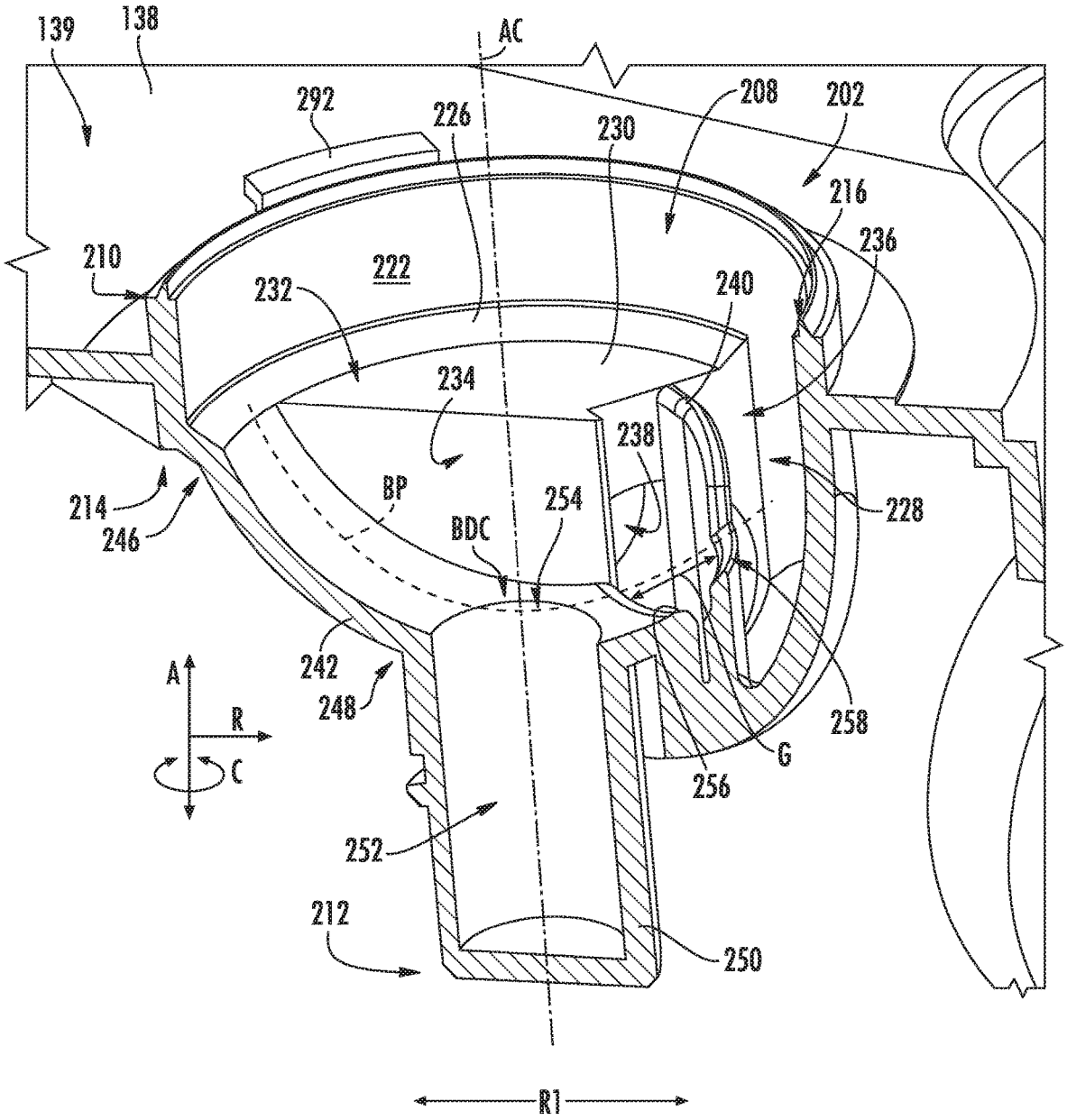
FIG. 4 provides a perspective cross-sectional view of the diverter bottom of FIG. 3 taken along line 4-4 of FIG. 3.

FIGS. 3 and 4 provide various views of sump 138 having a diverter bottom 202 integrated with a sump portion 139 of sump 138 according to various exemplary embodiments of the present disclosure. In particular, FIG. 3 provides a top perspective view of diverter bottom 202 integrally formed with sump 138. FIG. 4 provides a perspective cross-sectional view of diverter bottom 202 integrally formed with sump 138 taken along line 4-4 of FIG. 3.

Figure 5:
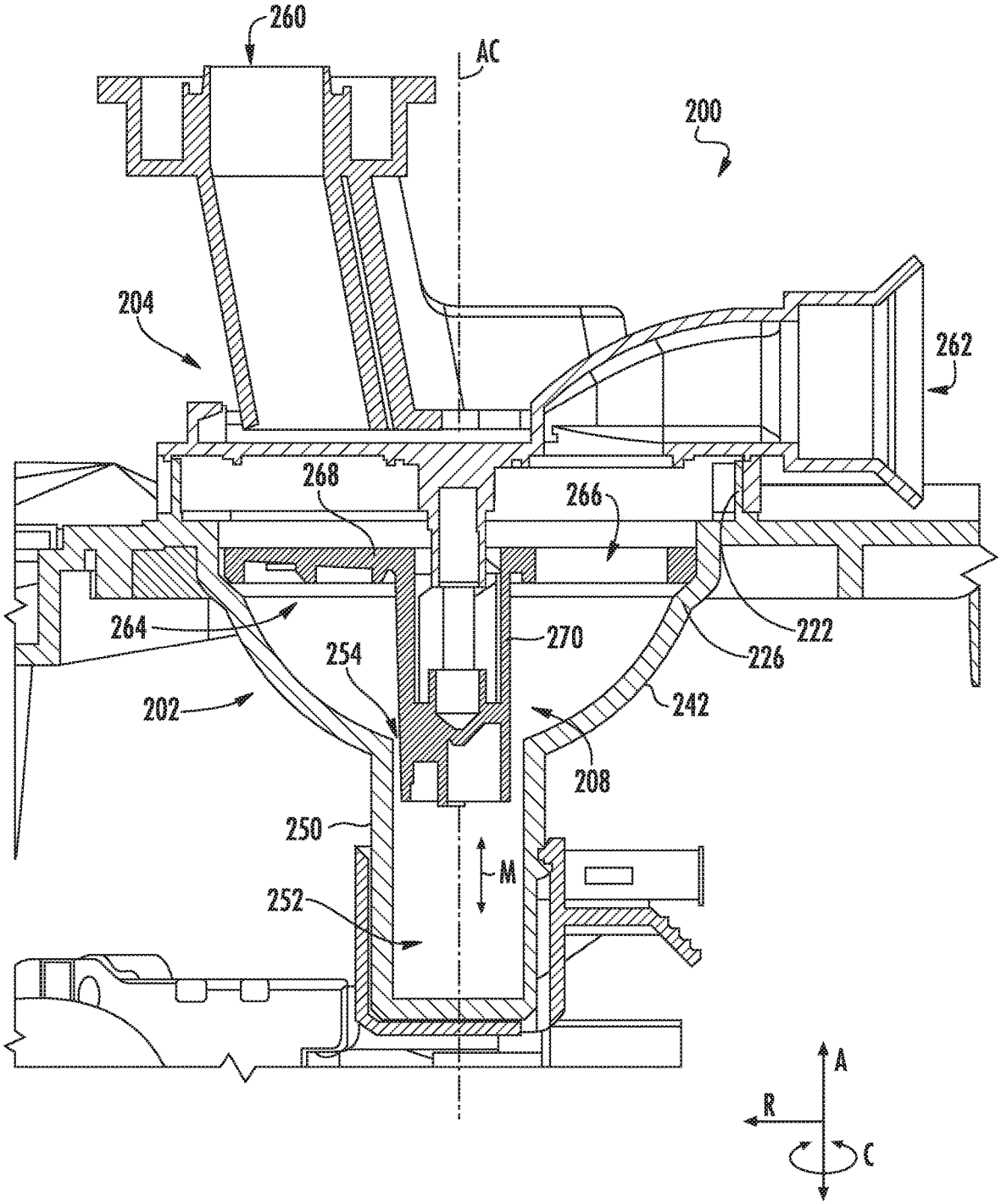
FIG. 5 provides a cross-sectional view of an exemplary diverter assembly of the dishwasher appliance of FIGS. 1 and 2 depicting a disc diverter top mounted to a diverter bottom.
Figure 6:
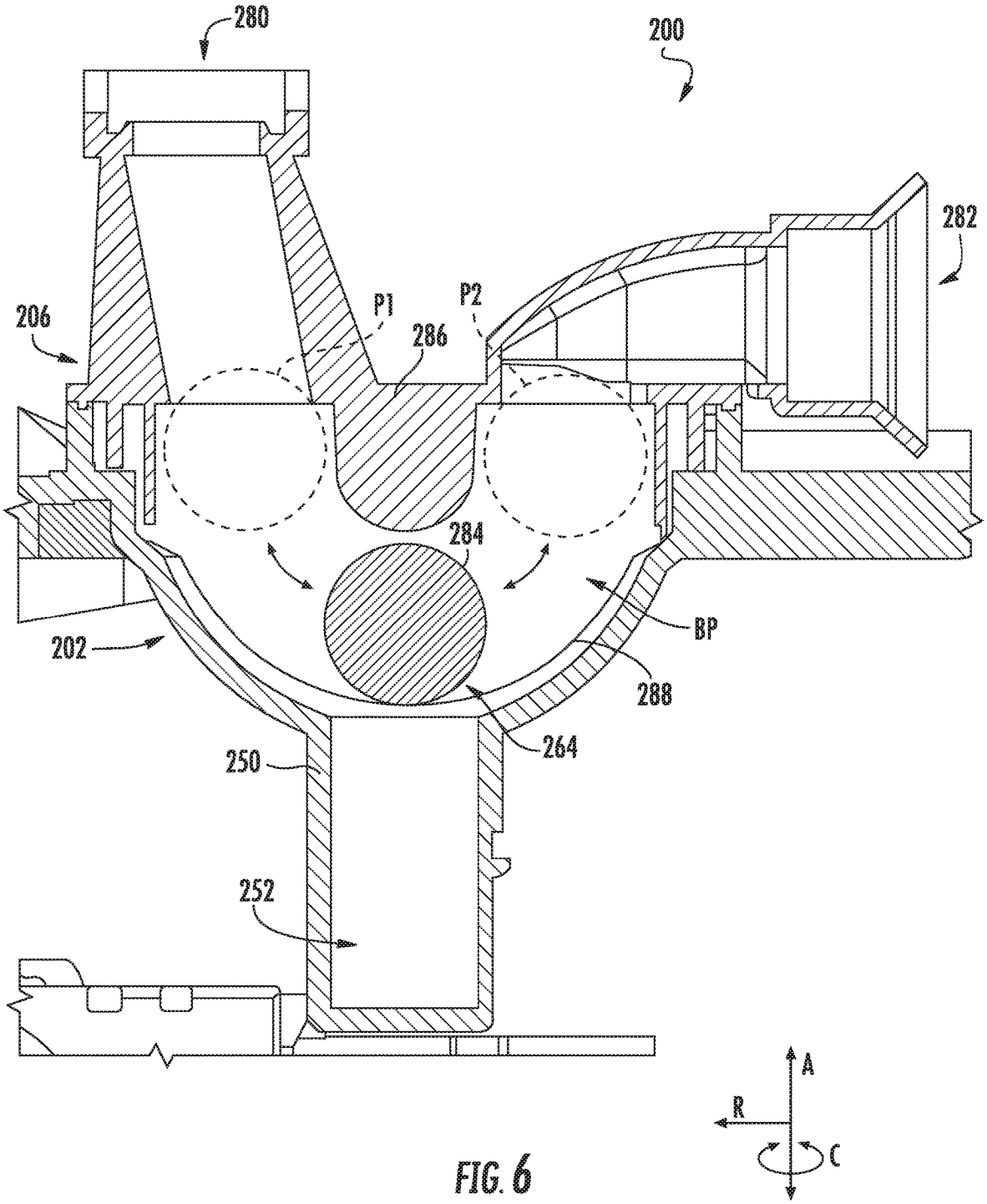
FIG. 6 provides a cross-sectional view of an exemplary diverter assembly of the dishwasher appliance of FIGS. 1 and 2 depicting a ball diverter top mounted to the diverter bottom.

Notably, for this embodiment, diverter bottom 202 is integrally formed with sump portion 139 of sump 138, as noted above and as will be explained in further detail herein. As diverter bottom 202 is integrally formed with sump 138, e.g., with a sump portion 139 of sump 138, leaks between sump 138 and diverter bottom are eliminated or reduced, assembly time is reduced as there is no longer a need to mount diverter bottom 202 to sump 138, and further, the part count of sump 138 and diverter bottom 202 may be reduced as mechanical fasteners are not needed to mount diverter bottom 202 to sump 138. Moreover, for this exemplary embodiment, diverter bottom 202 is configured such that it may receive varying diverter tops to form diverter 200. For instance, for this exemplary embodiment, diverter bottom 202 is configured to receive a disc diverter top coupled with a disc diverting element (FIG. 5) and may also receive a ball diverter top with a ball as the diverting element (FIG. 6). Advantageously, as diverter bottom 202 is configured for use with multiple diverter tops, e.g., disc diverter top 204 of FIG. 5 and ball diverter top 206 of FIG. 6, development of, tooling for, and manufacture of unitary sump 138 and integrated diverter bottom 202 of diverter 200 may be made more efficient and less costly. Sump 138 with integrated diverter bottom 202 will now be described in greater detail.

For reference purposes, diverter bottom 202 defines an axial direction A, a radial direction R extending outward from the actual direction A, and a circumferential direction C (e.g., extending three hundred sixty degrees) (360°) about the axial direction A). For this embodiment, the axial direction A extends along the vertical direction V (FIGS. 1 and 2). In addition, diverter bottom 202 defines an axial centerline AC as shown in FIG. 4.

As shown in FIGS. 3 and 4, diverter bottom 202 defines chamber 208, as noted above. Generally, for this exemplary embodiment, chamber 208 has a bowl-like shape and is sized to receive at least a portion of a diverter top therein. For instance, in FIG. 5 a portion of disc diverter top 204 is received or disposed within chamber 208 of diverter bottom 202. In FIG. 6, ball diverter top 206 is received or disposed within chamber 208 of diverter bottom 202.

More particularly, with reference to FIGS. 3 and 4, chamber 208 is defined by a number of walls and other internal features of diverter bottom 202. As shown, chamber 208 extends between a top region 210 and a bottom region 212 along the axial direction A (FIG. 4), which is the vertical direction V in this embodiment, and between a first side 214 and a second side 216 along a first radial direction R1 and between a third side 218 and a fourth side 220 along a second radial direction R2 (FIG. 3), which is a direction orthogonal to the first radial direction R1. Top region 210 of chamber 208 is defined by a circumferential wall 222 that extends about the circumferential direction C and extends above and below sump portion 139 of sump 138 along the axial direction A, as shown particularly in FIG. 4. Circumferential wall 222 defines top region 210 of chamber 208. Circumferential wall 222 is positioned adjacent a circumferential flange 224 that is disposed radially outward of and about circumferential wall 222 along the circumferential direction C. Circumferential flange 224 connects diverter bottom 202 with sump portion 139 and defines a perimeter of diverter bottom 202.

A chamfered ridge 226 extends inward from circumferential wall 222 along the radial direction R with respect to the axial centerline AC. As shown, chamfered ridge 226 extends along the circumferential direction C along at least a portion of circumferential wall 222. For this exemplary embodiment, chamfered ridge 226 does not extend from circumferential wall 222 at or proximate an inlet region 228 of chamber 208. In alternative exemplary embodiments, chamfered ridge 226 may extend about the entire circumferential wall 222.

As further shown in FIGS. 3 and 4, various surfaces of a recessed member 230 also defined chamber 208. As shown, recessed member 230 includes a recessed wall 232 that extends from chamfered ridge 226 along at least a portion of chamfered ridge 226. Recessed wall 232 extends in a plane orthogonal to the axial direction A. A first sidewall 234 of recessed member 230 shares an edge with recessed wall 232 and extends generally between the first side 214 and second side 216 along the first radial direction R1 and in a plane along the axial direction A. Further, recessed member 230 includes a second sidewall 236 that shares an axial extending edge with first sidewall 234 and a radial extending edge with recessed wall 232. As depicted, second sidewall 236 defines an inlet port 238. Inlet port 238 is configured to receive a flow of wash fluid from pump 152 (FIG. 2) so that diverter 200 may selectively allow a flow of fluid to one or more spray assemblies. Accordingly, inlet port 238 is in fluid communication with pump 152.

In addition, in this exemplary embodiment, a rib 240 extends from second sidewall 236. Rib 240 extends from second sidewall 236 and is positioned such that inlet port 238 is partially blocked or obstructed by rib 240. In this way, when diverter bottom 202 is paired with ball diverter top 206 (FIG. 6), as will be explained further below, a ball that functions as a diverting device is prevented from flowing into inlet port 238. Rib 240 extends from second sidewall 236 and terminates at an arcuate wall 242 of diverter bottom 202.

Generally, arcuate wall 242 defines a hemispherical volume of chamber 208, save for recessed member 230 and other features of diverter bottom 202 (e.g., rib 240) disposed within the hemispherical volume of chamber 208. As shown, arcuate wall 242 extends between a top portion 246 and a bottom portion 248 along the axial direction A (or vertical direction V). At top portion 246, arcuate wall 242 extends from chamfered ridge 226 and curves inward along the radial direction R and downward along the axial direction A to bottom portion 248. A cylinder 250 extends from arcuate wall 242 at or proximate bottom portion 248 of arcuate wall 242. Cylinder 250 defines a cylindrically-shaped well 252 of chamber 208 that is a volume contiguous or continuous with the hemispherical volume. Cylinder 250 defines an opening 254 in arcuate wall 242 at bottom portion 248. More particularly, cylinder 250 defines opening 254 in arcuate wall 242 at a bottom dead center BDC position of arcuate wall 242 (FIG. 4). Opening 254 in arcuate wall 242 is sized such that a ball functioning as a diverter device (FIG. 6) is prevented from traveling or falling into well 252 of cylinder 250.

For this embodiment, describing arcuate wall 242 along the first radial direction R1 and beginning at first side 214 of chamber 208, as shown, arcuate wall 242 extends from chamfered ridge 226 at first side 214 of chamber 208 and curves inward along the radial direction R and downward along the axial direction A to bottom portion 248 of arcuate wall 242, as noted above. After reaching bottom dead center BDC, arcuate wall 242 curves outward from the axial centerline AC along the radial direction R and upward along the axial direction A (or vertical direction V in this embodiment). At least a portion of arcuate wall 242 terminates at an inlet ridge 256. A gap G is defined between inlet ridge 256 and rib 240, as shown particularly in FIG. 4. Rib 240 comprises a rib path portion 258 that has a height that is complementary to the curvature of arcuate wall 242. That is, if arcuate wall 242 did not terminate at inlet ridge 256, rib path portion 258 has the height that arcuate wall 242 would have had along the axial direction A (or vertical direction V).

In this way, when the diverter top mounted to diverter bottom 220 is ball diverter top 206 and the diverter device is a ball (e.g., FIG. 6), arcuate wall 242 and rib 240, and more particularly rib path member 258, along with ball diverter top 206 define a ball path BP along which the ball is movable between a first position and a second position, or stated alternatively, the ball is movable to obstruct a first outlet port or a second outlet port defined by ball diverter top 206.

In alternative exemplary embodiments, diverter bottom 202 may not include rib 240. For instance, diverter bottom 202 is shown in FIGS. 5 and 6 without a rib structure. In such embodiments, arcuate wall 242 has a semicircular cross section as shown in FIGS. 5 and 6 that extends between first side 214 and second side 216 along the first radial direction R. Accordingly, in such embodiment, when the diverter top mounted to diverter bottom 220 is ball diverter top 206 and the diverter device is a ball (e.g., FIG. 6), arcuate wall 242 and ball diverter top 206 define ball path BP along which the ball is movable between a first position and a second position.

Further, for this exemplary embodiment, as noted above, sump portion 139 and diverter bottom 202 are integrally formed from a continuous piece of material such that sump portion 139 and diverter bottom 202 have a unitary construction and form unitary sump 138. That is, sump portion 139 and diverter bottom 202 are made together as a single unit or piece during manufacturing, i.e., from a continuous piece of material, to form unitary sump 138. A plastic, polymer, metal, or other material may be an appropriate material for constructing unitary sump 138. In some embodiments, unitary sump 138 may be formed from a combination of materials that are integrally formed as a continuous piece. That is, although one portion of sump 138 may be formed of a different material than another portion, the portions are integrally formed such that the portions are formed of a single, continuous piece, i.e., the different materials are integral.

The term "unitary" as used herein denotes that the associated component, such as sump 138 described herein, is made as a single piece during manufacturing, i.e., from a continuous piece of material. Thus, a unitary component has a monolithic construction and is different from a component that has been made from a plurality of component pieces that have been joined together to form a single component. More specifically, in the exemplary embodiment of FIGS. 3 and 4, sump portion 139 and diverter bottom 202 are constructed as a single unit or piece to form unitary sump 138.

A plastic, polymer, metal, or other material may be an appropriate material for constructing the unitary sump 138. In some embodiments, a combination of materials may be integrally formed as a continuous piece to form the unitary sump 138. That is, although one portion of sump 138 may be formed of a different material than another portion, the portions are integrally formed such that the portions are formed of a single, continuous piece, i.e., the different materials are integral. For example, the continuous piece of material may include a first material and a second material. In the exemplary embodiment of FIG. 3, sump portion 139 may be formed of the second material and diverter bottom 202 may be formed of the first material. The first and second materials may form a continuous piece of material, e.g., by fusing together the first and second materials where they meet or by successively printing one layer of sump 138 on top of another, as further described below.

In other embodiments, diverter bottom 202 may comprise a pre-fabricated structure and sump portion 139 is formed around diverter bottom 202 to produce unitary sump 138. For example, sump 138 may be formed using an additive process as described below and pre-fabricated diverter bottom 202 may be inserted within sump portion 139 during the additive process to form unitary sump 138 having diverter bottom 202.

FIGS. 5 and 6 provide views of varying diverter tops removably mounted to diverter bottom 202 according to exemplary embodiments of the present disclosure. More particularly, FIG. 5 provides disc diverter top 204 removably mounted to diverter bottom 202 and FIG. 6 provides ball diverter top 206 removably mounted to diverter bottom 202. Notably, diverter bottom 202 has the same geometry in FIGS. 5 and 6 while the diverter tops removably mounted thereto have different geometries.

As shown in FIG. 5, disc diverter top 204 defines a plurality of outlet ports; however, only a first outlet port 260 and a second outlet port 262 are shown in the cross-section view of the exemplary embodiment of FIG. 5. In alternative embodiments, disc diverter top 204 may define two, three, four, or more outlet ports depending upon, e.g., the number of switchable ports desired for selectively placing pump 152 (FIG. 2) in fluid communication with different fluid-using elements of dishwasher 100 (FIG. 2).

For the depicted embodiment of FIG. 5, diverter 200 includes a rotatable diverter element 264 that is operatively coupled with disc diverter top 204. As shown, diverter element 264 has an aperture 266 that can be selectively switched between the plurality of outlet ports, including first and second outlet ports 260 and 262. For example, the outlet ports may be spaced apart along a circumferential direction C, and in an exemplary embodiment having four outlet ports, the outlet ports may be spaced apart along the circumferential direction C at angles of ninety degrees (90°). Thus, the rotation of diverter element 264 by ninety degrees (90°) necessarily rotates aperture 266 so as to selectively provide fluid flow from one outlet port to the next outlet port along the direction of rotation.

In the exemplary embodiment of FIG. 5, diverter element 264 is a disc 268 that can be rotated about the axial centerline AC to selectively switch aperture 266 between the plurality of outlet ports to place an outlet port in fluid communication with chamber 208 of disc diverter top 204. Thus, through the rotation of diverter element 264, diverter 200 can be used to selectively provide fluid flow from pump 152 through chamber 208 to any one of the outlet ports. By way of example, first outlet port 260 can be fluidly connected with upper spray assembly 142, second outlet port 262 can be fluidly connected with mid-level spray-arm assembly 140, and third and fourth outlet ports might be fluidly connected with lower spray-arm assembly 134 (see FIG. 2). As such, the rotation of disc 268 can be used to selectively place pump 152 in fluid communication with any one of the spray assemblies 142, 140, or 134 by way of the plurality of outlet ports. Other connection configurations may be used as well.

For this exemplary embodiment, a cylindrically-shaped shaft 270 extends from disc 268. More particularly, shaft 270 extends downward from disc 268 along the axial direction A. Shaft 270 extends at least partially into cylindrically-shaped well 252 defined by cylinder 250 that forms part of diverter bottom 202. As shown, well 252 defined by cylinder 250 is part of chamber 208 and is contiguous with the hemispherical volume of chamber 208 generally defined by arcuate wall 242, circumferential wall 222, chamfered ridge 226, etc. Shaft 270 is movable within well 252 of cylinder 250 along the axial direction A between a first position (FIG. 5) and a second position (not shown), denoted by arrow M in FIG. 5. Moreover, shaft 270 is rotatable about the axial centerline AC relative to diverter bottom 202, e.g., as disc 268 is rotated about to selectively direct fluid into the appropriate outlet port.

In addition, for this embodiment, diverter 200 is a passive diverter device. That is, diverter device 200 does not include a driving element, e.g., a motor, to actively switch diverter element 264 between various positions to selectively control the flow of fluid to particular spray assemblies. Rather, diverter 200 of FIG. 3 relies on passive forces, such as e.g., the pressure of the fluid within diverter 200 or more broadly the fluid system as is known in the art, to drive internal features within disc 268 and shaft 270 such that rotation of diverter element 264 is accomplished. As one example, when passive forces are not acting on the internal features within disc 268 and shaft 270, the disc 268 and shaft 270 extending therefrom are moved downward along the axial direction A via gravity, e.g., within well 252 of cylinder 250. When passive forces are applied to the internal features within disc 268 and shaft 270 bias disc 268 in the circumferential direction C while passive forces push upward along the axial direction A. Consequently, rotation of disc 268 and shaft 270 results. In this way, aperture 266 defined by disc 268 is moved, e.g., along the circumferential direction C, such that fluid communication between pump 152 and another spray assembly is achieved. In alternative exemplary embodiments, a motor or other driving element may be mechanically coupled with shaft 270. In such alternative embodiments, the motor may drive shaft 270 about such that disc 268 rotates and aperture 266 is positioned in the desired position such that fluid may flow to the desired wash zone within tub 104.

As shown in FIG. 6, ball diverter top 206 is mounted to diverter bottom 202, which has the same geometry of the diverter bottom depicted in FIG. 5. Ball diverter top 206 defines a plurality of outlet ports. For this exemplary embodiment, ball diverter top 206 defines two outlet ports, including first outlet port 280 and second outlet port 282. In some embodiments, ball diverter top 206 may define more than two outlet ports. Outlet ports 280, 282 are in fluid communication with one or more of the spray arm assemblies 134, 140, 142 (FIG. 2).

For this exemplary embodiment, diverter element 264 is a ball 284 that is movable between a first position and a second position along U-shaped ball path BP. In the first position P1 (shown in phantom in FIG. 6), ball 284 obstructs first outlet port 280 from receiving a flow of wash fluid and thus diverts a fluid flow to second outlet port 282. When ball 284 is in the second position P2 (shown in phantom in FIG. 6), ball 284 obstructs second outlet port 282 from receiving a flow of wash fluid and thus diverts a fluid flow to first outlet port 280. Ball 284 may be moved between the first and second positions P1, P2 due to fluid pressure exerted on diverter ball 284 during operation of dishwasher appliance 100 (FIGS. 1 and 2). For example, prior to the operation of dishwasher 100, ball 284 may be positioned at an intermediate location along ball path BP between first and second outlet ports 280, 282, such as at the position of ball 284 shown in FIG. 6. Thereafter, when pump 152 begins to deliver fluid to diverter 200, the pressure of the fluid flowing into diverter bottom 202 via diverter inlet port 238 (FIGS. 3 and 4) may force ball 284 upwards into its first position P1 such that it is sealed against first outlet port 280. As such, all of the fluid flowing into diverter 200 may be initially diverted to second outlet port 282 for subsequent discharge to one of the spray arm assemblies. Thereafter, when it is desired to divert the fluid from pump 152 (FIG. 2) to first outlet port 280, pump 152 may be temporarily cut off such that the pressure build-up of the fluid contained within fluid circulation assembly 150 (FIG. 2) forces ball 284 into its second position P2 such that it is sealed against second outlet port 282. Pump 152 may then be turned on such that the pressure of the fluid flowing into diverter bottom 202 via diverter inlet port 238 maintains ball 284 sealed against second outlet port 282, thereby allowing the fluid flowing into diverter 200 to be diverted to first outlet port 280 for subsequent discharge from other spray arm assemblies or manifolds.

As further shown in FIG. 6, at least a portion of ball diverter top 206 is received or disposed within chamber 208 of diverter bottom 202, and when ball diverter top 206 is mounted with diverter bottom 202, ball path BP is defined between ball diverter top 206 and arcuate wall 242 of diverter bottom 202 along the axial direction A (or vertical direction V in this embodiment). More particularly, ball diverter top 206 includes a top wall 286 that is shaped complementary to arcuate wall 242 of diverter bottom 202. In this way, when ball diverter top 206 is mounted with diverter bottom 202, U-shaped ball path BP is defined between arcuate wall 242 of diverter bottom 202 and top wall 286 of ball diverter top 206.

In addition, to constrain the movement of ball 284 within ball path BP, ball diverter top 206 includes a sidewall 288 (shown transparent in FIG. 6) that extends in a plane along the axial direction A (or vertical direction V). Sidewall 288 is spaced from first sidewall 234 of recessed member 230 (FIGS. 3 and 4) and extends parallel or substantially parallel to first sidewall 234 of diverter bottom 202. Sidewall 288 is spaced from first sidewall 234 so as to accommodate ball 284 within ball path BP. In this way, first sidewall 234 of recessed member 230 of diverter bottom 202 and sidewall 288 of ball diverter top 206 constrain ball 284 along the ball path BP, e.g., along the second radial direction R2 (FIG. 3).

Figure 7:
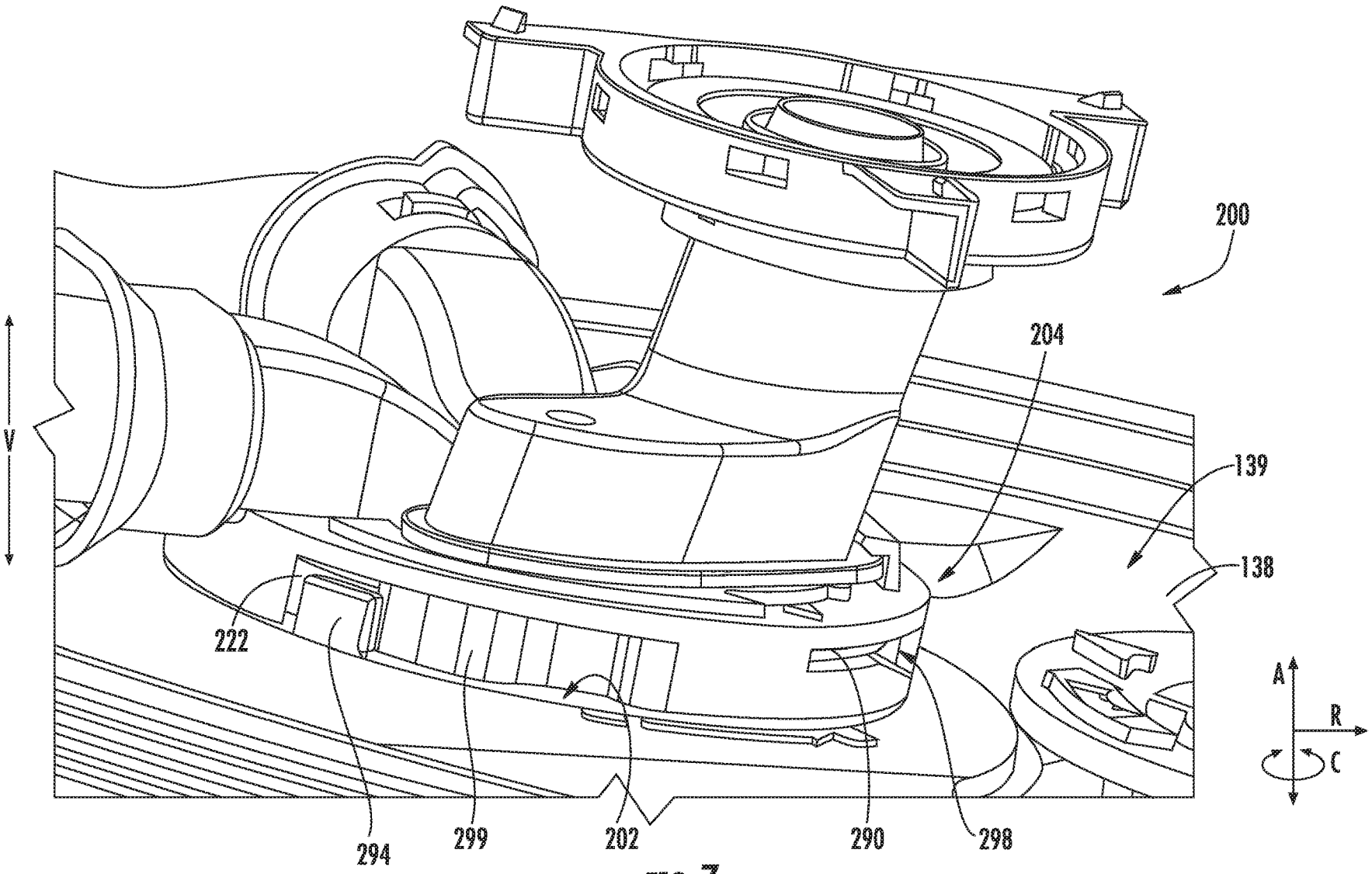
FIG. 7 provides a perspective view of a diverter top mounted to diverter bottom according to an exemplary embodiment of the present disclosure.

FIG. 7 provides a perspective view of disc diverter top 204 mounted to diverter bottom 202 of sump 138. As shown, disc diverter top 204 may be mounted to diverter bottom 202 by twisting disc diverter top 204 about the axial direction A (or vertical direction V in this embodiment) such that locking features of diverter bottom 202 interlock with features of disc diverter top 204.

For instance, as shown particularly in FIG. 3, a first guide member 290 and a second guide member 292 project from circumferential flange 224 upward along the axial direction A and each extend along the circumferential direction C. Further, a lock tab 294 also projects from circumferential flange 224 upward along the axial direction A and extends along the circumferential direction C. As shown in FIG. 3, lock tab 294 includes an inner surface 296 that is wedged or angled with respect to the circumferential direction C.

With reference to FIG. 7, to install disc diverter top 204 with diverter bottom 202, disc diverter top 204 is positioned such that it is aligned with diverter bottom 202. Disc diverter top 204 is then lowered along the axial direction A such that disc diverter top 204 is in mating communication with diverter bottom 202. Notably, when disc diverter top 204 is positioned in mating communication with diverter bottom 202, first guide member 290 is received within a first groove 298 defined by circumferential wall 222 of diverter top 204 and second guide member 292 is received within a second groove (not shown) defined by circumferential wall 222. Thereafter, disc diverter top 204 is twisted about the axial direction A, and as this occurs, a lock strip 299 of disc diverter top 204 engages lock tab 294. When lock strip 299 of disc diverter top 204 engages lock tab 294 of diverter bottom 202, lock strip 299 is wedged against inner surface 296 of lock tab 294. This locks diverter top 204 in place and prevents further rotation of disc diverter top 204 about the axial direction A. In this way, disc diverter top 204 is secured to diverter bottom 202. To uninstall disc diverter top 204 from diverter bottom 202, a twisting force is applied to disc diverter top 204 such that lock strip 299 of diverter top 204 disengages from inner surface 296 of lock tab 294. Ball diverter top 206 (FIG. 6) may be installed or removed from diverter bottom 202 to form diverter 200 in the same or similar manner as described above. As the diverter tops may be mounted to or removed from diverter bottom 202, the diverter tops are removably mounted from diverter bottom 202.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance, comprising:

a tub defining a wash chamber;

a plurality of spray arm assemblies for directing fluid into the wash chamber;

a pump;

a sump positioned at or proximate a bottom portion of the tub, the sump comprising a sump portion and a diverter bottom, the diverter bottom defining an inlet port in fluid communication with the pump and comprising an arcuate wall and a cylinder extending from the arcuate wall, the arcuate wall and the cylinder defining a chamber;

a diverter top removably mounted to the diverter bottom to form a diverter, the diverter top defining at least two outlets ports in fluid communication with the plurality of spray arm assemblies; and a diverter element comprising a ball that is movable within the chamber, the diverter element configured to divert fluid from the inlet to the plurality of outlet ports, wherein the arcuate wall and a rib of the diverter bottom and a top wall of the diverter top define a ball path along which the ball is moveable between a first position and a second position, wherein the inlet port of the diverter bottom is at least partially obstructed by the rib.

2. The dishwasher appliance of claim 1, wherein the sump and the diverter bottom are formed of a continuous piece of material such that the sump and diverter bottom are a single unitary component.

3. The dishwasher appliance of claim 1, wherein the diverter element is a ball and the arcuate wall of the diverter bottom and a top wall of the diverter top define a ball path along which the ball is moveable between a first position and a second position.

4. The dishwasher appliance of claim 1, wherein the diverter element is a disc comprising a shaft extending therefrom, the disc coupled with the diverter top, and wherein the shaft is moveable within the cylinder.

5. The dishwasher appliance of claim 1, wherein the diverter defines an axial direction and a radial direction, and wherein the arcuate wall extends between a top portion and a bottom portion along the axial direction, and wherein the cylinder extends from the arcuate wall at or proximate the bottom portion of the arcuate wall.

6. The dishwasher appliance of claim 1, wherein the arcuate wall of the diverter bottom has a semicircular cross section.

7. The dishwasher appliance of claim 1, wherein the chamber defined by the diverter bottom extends between a first side and a second side along a first radial direction, and wherein the arcuate wall extends between the first side and the second side.

8. The dishwasher appliance of claim 1, wherein the diverter bottom comprises a circumferential wall defining a top region of the chamber, the circumferential wall extending about the circumferential direction and in a plane along the axial direction.

9. A dishwasher appliance defining a vertical direction, a lateral direction, and a transverse direction, the dishwasher appliance comprising:

a tub defining a wash chamber;

a plurality of spray arm assemblies for directing fluid into the wash chamber;

a pump;

a sump positioned at or proximate a bottom portion of the tub along the vertical direction, the sump comprising a sump portion and a diverter bottom integrally formed with the sump portion, the diverter bottom defining an inlet port in fluid communication with the pump, the diverter bottom comprising an arcuate wall extending between a top portion and a bottom portion along the vertical direction and a cylinder extending from the arcuate wall along the vertical direction, the arcuate wall and the cylinder defining a chamber, wherein the diverter bottom defines an axial centerline extending through the cylinder and a radial direction, and wherein the diverter bottom comprises a circumferential wall defining a top region of the chamber, the circumferential wall extending in a plane along the vertical direction, and wherein a chamfered ridge extends inward from the circumferential wall along the radial direction with respect to the axial centerline, and wherein the arcuate wall extends from the chamfered ridge;

a diverter top removably mounted to the diverter bottom to form a diverter, the diverter top defining at least two outlets ports in fluid communication with the plurality of spray arm assemblies; and a diverter element movable within the chamber, the diverter element configured to divert fluid from the inlet to the plurality of outlet ports.

10. The dishwasher appliance of claim 9, wherein the cylinder defines an opening in the arcuate wall.

11. The dishwasher appliance of claim 10, wherein the diverter element is a ball and the arcuate wall of the diverter bottom and a top wall of the diverter top defines a ball path along which the ball is moveable, and wherein the opening in the arcuate wall is sized such that the ball is prevented from traveling into the cylinder.

12. The dishwasher appliance of claim 9, wherein the diverter element is a disc coupled with the diverter top, the disc extending in a plane orthogonal to the vertical direction and comprising a shaft extending therefrom along the vertical direction, and wherein the shaft is moveable within the cylinder between a first position and a second position.

13. The dishwasher appliance of claim 9, wherein when the diverter top is mounted with the diverter bottom, a U-shaped ball path is defined between the diverter top and the arcuate wall of the diverter bottom.

14. A dishwasher appliance defining a vertical direction, a lateral direction, and a transverse direction, the dishwasher appliance comprising:

a tub defining a wash chamber;

a plurality of spray arm assemblies for directing fluid into the wash chamber;

a pump;

a sump positioned at or proximate a bottom portion of the tub along the vertical direction, the sump comprising a sump portion and a diverter bottom integrally formed with the sump portion, the diverter bottom defining an inlet port in fluid communication with the pump, the diverter bottom comprising an arcuate wall extending between a top portion and a bottom portion along the vertical direction and a cylinder extending from the arcuate wall along the vertical direction, the arcuate wall and the cylinder defining a chamber;

a diverter top removably mounted to the diverter bottom to form a diverter, the diverter top defining at least two outlets ports in fluid communication with the plurality of spray arm assemblies; and a diverter element movable within the chamber, the diverter element configured to divert fluid from the inlet to the plurality of outlet ports;

wherein the diverter bottom comprises a first guide member, a second guide member, and a lock tab and the diverter top defines a first groove and a second groove, and wherein the first guide member is receivable within the first groove and the second guide member is receivable with the second groove, and wherein the diverter top is mounted by twisting the diverter top relative to the diverter bottom such that the diverter top engages the lock tab.

15. A dishwasher appliance defining a vertical direction, a lateral direction, and a transverse direction, the dishwasher appliance comprising:

a tub defining a wash chamber;

a plurality of spray arm assemblies for directing fluid into the wash chamber;

a pump;

a sump positioned at or proximate a bottom portion of the tub along the vertical direction, the sump comprising a sump portion and a diverter bottom integrally formed with the sump portion, the diverter bottom defining an inlet port in fluid communication with the pump, the diverter bottom comprising an arcuate wall extending between a top portion and a bottom portion along the vertical direction and a cylinder extending from the arcuate wall along the vertical direction, the arcuate wall and the cylinder defining a chamber;

a diverter top removably mounted to the diverter bottom to form a diverter, the diverter top defining at least two outlets ports in fluid communication with the plurality of spray arm assemblies; and a diverter element movable within the chamber, the diverter element configured to divert fluid from the inlet to the plurality of outlet ports;

wherein the diverter bottom comprises a recessed member comprising a first sidewall extending in a plane along the vertical direction and along at least a portion of the arcuate wall, and wherein the diverter top is a ball diverter top and the diverter element is a ball, the arcuate wall of the diverter bottom and a top wall of the diverter top defining a ball path along which the ball is moveable between a first position and a second position, and wherein the ball diverter top comprises a sidewall that extends in a plane along the vertical direction and is spaced from the first sidewall of the recessed member, the first sidewall of the recessed member extending substantially parallel with the sidewall of the diverter top, and wherein the first sidewall of the recessed member of the diverter bottom and the sidewall of the diverter top constrain the ball along the ball path.

* * * * *